US008193116B2

(12) United States Patent
Orihara et al.

(10) Patent No.: US 8,193,116 B2
(45) Date of Patent: Jun. 5, 2012

(54) HEAT-SENSITIVE RECORDING MATERIAL

(75) Inventors: Motoi Orihara, Numazu (JP); Norihiko Inaba, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/248,519

(22) Filed: Sep. 29, 2011

(65) Prior Publication Data

US 2012/0021900 A1 Jan. 26, 2012

Related U.S. Application Data

(63) Continuation of application No. 12/050,535, filed on Mar. 18, 2008, now Pat. No. 8,058,209.

(30) Foreign Application Priority Data

Mar. 19, 2007 (JP) ..... 2007-071256

(51) Int. Cl.
*B41M 5/42* (2006.01)

(52) U.S. Cl. ..... 503/226; 503/200

(58) Field of Classification Search ..... None
See application file for complete search history.

(56) References Cited

U.S. PATENT DOCUMENTS

| | | | |
|---|---|---|---|
| 4,467,339 | A | 8/1984 | Asami et al. |
| 4,506,278 | A | 3/1985 | Sakamoto et al. |
| 4,507,669 | A | 3/1985 | Sakamoto et al. |
| 4,616,240 | A | 10/1986 | Inaba et al. |
| 5,200,385 | A | 4/1993 | Inoue et al. |
| 5,646,088 | A | 7/1997 | Hada et al. |
| 5,703,006 | A | 12/1997 | Mori et al. |
| 5,827,590 | A | 10/1998 | Morita et al. |
| 6,784,136 | B2 | 8/2004 | Iwasaki et al. |
| 2002/0155950 | A1 | 10/2002 | Iwasaki et al. |

FOREIGN PATENT DOCUMENTS

| | | | |
|---|---|---|---|
| EP | 1211094 | A2 | 6/2002 |
| EP | 1243439 | A1 | 9/2002 |
| EP | 1637339 | A1 | 3/2006 |
| JP | 55-164192 | | 12/1980 |
| JP | 59-5093 | | 1/1984 |
| JP | 59-225987 | | 12/1984 |
| JP | 60-15190 | | 1/1985 |
| JP | 63-281886 | | 11/1988 |
| JP | 2-214688 | | 8/1990 |
| JP | 3-205181 | | 9/1991 |
| JP | 8-151412 | | 6/1996 |
| JP | 2678358 | | 8/1997 |
| JP | 10-87936 | | 4/1998 |
| JP | 11-314457 | | 11/1999 |
| JP | 2001-293956 | | 10/2001 |
| JP | 2002-211131 | | 7/2002 |
| JP | 2002-283717 | | 10/2002 |
| JP | 2003-182229 | | 7/2003 |
| JP | 2005-313597 | | 11/2005 |

OTHER PUBLICATIONS

Jun. 12, 2008 European search report in connection with corresponding European patent application No. 08 102 726.

*Primary Examiner* — Bruce H Hess
(74) *Attorney, Agent, or Firm* — Cooper & Dunham LLP

(57) ABSTRACT

To provide a heat-sensitive recording material including a substrate; a heat-sensitive color-developing layer over the substrate, the heat-sensitive color-developing layer containing a leuco dye and a developer; a first protective layer over the heat-sensitive color-developing layer, the first protective layer containing a water-soluble resin and a crosslinking agent; and a second protective layer over the first protective layer, the second protective layer containing a water-soluble resin, a crosslinking agent and a pigment, wherein the heat-sensitive color-developing layer, the first protective layer and the second protective layer are formed simultaneously by curtain coating method, and the second protective layer contains diacetone-modified polyvinyl alcohol and acrylic resin or maleic acid copolymer resin.

1 Claim, No Drawings

HEAT-SENSITIVE RECORDING MATERIAL

CROSS-REFERENCE TO RELATED APPLICATION

This application is a Rule 1.53(b) continuation of application Ser. No. 12/050,535, filed Mar. 18, 2008, now U.S. Pat. No. 8,058,209 which in turn claims the priority of Japanese Patent Application No. 2007-071256 filed with the Japanese Patent Office on Mar. 19, 2007.

BACKGROUND OF THE INVENTION

1. Field of the Invention

The present invention relates to a heat-sensitive recording material that can be used in a wide spectrum of fields including printers for computer output and calculators, recorders for medical instruments, low-speed and high-speed facsimiles, automatic ticket machines, heat-sensitive photography, handy terminals, and labels for the POS system.

2. Description of the Related Art

Various types of recording materials have been proposed in which a heat-sensitive recording layer that contains as main components a colorless or light-colored leuco dye and a developer that produces color upon contact with the dye is provided on a substrate such as paper, synthetic paper, plastic film or the like, so that developing reactions between the leuco dye and developer effected by application of heat or pressure are utilized. These types of heat-sensitive recording materials require no troublesome treatments like developing and fixing, offering such advantages as shorter recording time with a relatively simple device, low noise level, and low costs. These advantages have enabled them to be available not only for copying of books and documents, but also as recording materials for use in a variety of fields including computers, facsimiles, ticket machines, label printers, recorders, and handy terminals.

What is demanded for heat-sensitive recording materials is quick, highly dense developing, with high robustness in the developed image and background.

In regard to attempts to achieve increased sensitivity, method have been proposed (see Japanese Patent Application Laid-Open (JP-A) Nos. 59-5093 and 59-225987) in which the thermal conductivity of the substrate is 0.04 kcal/m-hr-° C. and various types of hollow microparticles (resin, glass, aluminosilicates or the like) are used as the intermediate layer as disclosed in JP-A No. 55-164192. However, in these cases, it is difficult to form a uniform intermediate layer and the surface readily becomes uneven, leading to poor resolution (dot reproducibility) in the formed image. Furthermore, a method has been proposed (see JP-A No. 63-281886) in which styrene acrylic resin and polystyrene resin are used as the partition materials of the above-described hollow microparticles, and an intermediate layer is formed, the main components of which are non-foamed hollow microparticles with a hollow ratio of 30% or more (JP-A No. 02-214688). However, even in this case, adequate insulating effects cannot be obtained because the hollow ratio is low, so that the highly sensitive heat-sensitive recording material current being sought cannot be obtained.

Furthermore, in recent years, such recording materials have come to be abundantly used in fields where fidelity of recorded images is deemed critical, such as labels and receipts. Accordingly, recording materials are in demand that have high resistance against water and acidic substances in foods, and oils and plasticizers in organic polymer materials used in packages.

There have been attempts to overcome the aforementioned drawbacks for instance by providing a protective layer on the heat-sensitive recording layer. In particular, it has been proposed that polyvinyl alcohols or modified polyvinyl alcohols be used as the resin for the protective layer, and that these polyvinyl alcohols and a waterproofing agent be used together as the protective layer.

For example, JP-A No. 08-151412 discloses using a hydrazine compound and a diacetone group-containing polyvinyl alcohol, but when they are used in an overcoat of the heat-sensitive recording material, the waterproof reaction is promoted in their coating solution followed by unwanted increase in viscosity with time. In addition, JP-A No. 11-314457 proposes that a diacetone-modified polyvinyl alcohol be used in the resin of the protective layer and that a hydrazine compound be contained in the heat-sensitive color-developing layer, but the problems arise that the waterproof capabilities of the protective layer are insufficient, the viscosity of the coating solution on the heat-sensitive color-developing layer increases and developing of the heat-sensitive color-developing layer is inhibited by the hydrazide compound. In addition, in JP-A No. 10-87936, a waterproofing method is proposed that uses water-soluble amines, hydrazide compounds and polyvinyl alcohol copolymers containing diacetone acryl amide as a monomer. However, when they are used in an overcoat of the heat-sensitive recording material, amines undesirably affect the heat-sensitive color-developing layer to cause coloring in the background, pH control with amines becomes difficult and, depending on the added amine amount, viscosity increases conversely.

Regarding increase in viscosity, JP-A No. 2002-283717 attempts to solve this problem by using a hydrazide compound as a crosslinking agent for a polyvinyl alcohol having a reactive carbonyl group, and also by incorporating a basic filler.

When heat-sensitive recording materials that use hydrazide compounds and polyvinyl alcohol containing a reactive carbonyl group are used, however, an image printed with aqueous ink for flexography is easily peeled off by external force after long-time exposure to water.

Meanwhile, the curtain coating method has received attention for its advantages including significant reduction in expenditures involved in drying equipment and energy, which are achieved by increased coating speed and simultaneous multilayer coating associated with recent demands for increased productivity. JP-A No. 2003-182229 discloses producing a heat-sensitive recording layer by curtain coating in order to obtain a heat-sensitive recording material with excellent sensitivity, quality and matching properties with a thermal head. However, this patent literature remains silent with respect to a heat-sensitive recording material which offers excellent printing suitability and head matching properties and with which high-speed coating is possible.

BRIEF SUMMARY OF THE INVENTION

It is an object of the present invention to solve the foregoing problems pertinent in the art and to provide a heat-sensitive recording material with high sensitivity, excellent storage properties, printing suitability and head matching properties and with which high-speed coating is possible.

The above-mentioned problems are solved by the following aspects 1) through 12) of the present invention.

1) A heat-sensitive recording material including: a substrate; a heat-sensitive color-developing layer over the substrate, the heat-sensitive color-developing layer containing a leuco dye and a developer; a first protective layer over the heat-sensitive color-developing layer, the first protective layer containing a water-soluble resin and a crosslinking agent; and a second protective layer over the first protective layer, the second protective layer containing a water-soluble resin, a crosslinking agent and a pigment, wherein the heat-sensitive color-developing layer, the first protective layer and the second protective layer are formed simultaneously by curtain coating method, and the second protective layer contains diacetone-modified polyvinyl alcohol and acrylic resin or maleic acid copolymer resin.

2) The heat-sensitive recording material according to 1), wherein the water-soluble resin in the first protective layer is diacetone-modified polyvinyl alcohol and the first protective layer contains acrylic resin or maleic acid copolymer resin.

3) The heat-sensitive recording material according to any one of 1) and 2), wherein the acrylic resin or maleic acid copolymer resin in the second protective layer is a water-soluble salt of a diisobutylene-maleic acid anhydride copolymer.

4) The heat-sensitive recording material according to any one of 2) and 3), wherein the acrylic resin or maleic acid copolymer resin in the first protective layer is a water-soluble salt of a diisobutylene/maleic acid anhydride copolymer.

5) The heat-sensitive recording material according to any one of 2) and 3), wherein the acrylic resin or maleic acid copolymer resin in the first protective layer is an aqueous solution of an acrylic cation polymer.

6) The heat-sensitive recording material according to any one of 1) to 5), wherein the second protective layer contains at least one of aluminum hydroxide and calcium carbonate as a basic filler.

7) The heat-sensitive recording material according to any one of 1) to 6), wherein the second protective layer contains silicone resin particles.

8) The heat-sensitive recording material according to any one of 1) to 7), further including a under layer provided between the substrate and the heat-sensitive color-developing layer, wherein the under layer contains plastic hollow particles having an average particle diameter of 2 μm to 5 μm and a hollow ratio of 80% to 95%.

9) The heat-sensitive recording material according to any one of 1) to 8), further including a back layer on a back surface of the substrate, wherein the back layer contains a pigment, a water-soluble resin and a crosslinking agent.

10) The heat-sensitive recording material according to any one of 1) to 9), further including an adhesive layer and separation paper sequentially provided over a surface of the back layer or the back surface of the substrate.

11) The heat-sensitive recording material according to any one of 1) to 10), further including a heat-sensitive adhesive layer provided over a surface of the back layer or the back surface of the substrate, wherein the heat-sensitive adhesive layer exerts adhesiveness upon heated.

12) The heat-sensitive recording material according to any one of 1) to 9), further including a magnetic recording layer provided over a surface of the back layer or the back surface of the substrate.

DETAILED DESCRIPTION OF THE INVENTION

The present invention is detailed below.

In the present invention, a heat-sensitive color-developing layer, a first protective layer and a second protective layer are simultaneously formed by curtain coating. This reduces the number of process steps as well as the cost of equipment, and multiple layers are easily created. Thus it is possible to isolate the functions the respective layers.

The viscosity of the coating solutions used in curtain coating (as measured with type-B viscosity gauge at 25° C.) is preferably 100 mPa-s to 500 mPa-s, and more preferably 150 mPa-s to 400 mPa-s. When the viscosity of the coating solutions is less than 100 mPa-s, the coating solutions are mixed together, causing a drop in sensitivity. In addition, when the viscosity is higher than 500 mPa-s, differences occur in flow rate of the coating solutions between the central portion and portions near the edge guides over the length of the curtain nozzle, whereby the amount of deposits increases at the edges of the coating, creating raised portions on the coating.

The second protective layer contains water-soluble resin, a crosslinking agent and pigment.

As the pigment, it is possible to use inorganic fine particles, such as, for example, aluminum hydroxide, calcium carbonate, silica, zinc oxide, titanium oxide, zinc hydroxide, barium sulfate, clay, talc or surface-treated calcium or silica. In particular, aluminum hydroxide and calcium carbonate have good wear resistance with respect to thermal heads when printing over the long term.

As water-soluble resins (binder resins), examples that can be cited include polyvinyl alcohols; starch and derivatives thereof; cellulose derivatives such as methoxy-cellulose, hydroxyethyl cellulose or carboxymethyl cellulose; or water-soluble polymers such as polyacrylate soda, polyvinyl pyrrolidone, alkali salts of styrene/maleic acid anhydride copolymers, alkali salts of isobutylene/maleic acid anhydride copolymers, polyacrylamide, gelatin or casein. However, resins with high heat-resistance that are not likely to thermally break down or soften are beneficial for improving sticking, and from that perspective, a polyvinyl alcohol containing a reactive carbonyl group is preferable. Among these, in the present invention a diacetone-modified polyvinyl alcohol is invariably used.

A polyvinyl alcohol containing a reactive carbonyl group can be produced through a commonly known method such as saponification of a polymer obtained through copolymerization of a vinyl monomer containing a reactive carbonyl group and a fatty acid vinyl ester. As vinyl monomers containing a reactive carbonyl group, a group containing an ester bond and a group containing an acetone group can be cited, but to obtain diacetone-modified polyvinyl alcohol, diacetone acrylamide, metadiacetone acrylamide or the like is used. As the fatty acid vinyl ester, vinyl formate, vinyl acetate, vinyl propionate and the like can be cited, but vinyl acetate is preferable.

The diacetone-modified polyvinyl alcohol may also be one made by copolymerization of vinyl monomers. As vinyl monomers capable of undergoing copolymerization, for example ester acrylate, butadiene, ethylene, propylene, acrylic acid, methacrylic acid, maleic acid, maleic acid anhydride, itaconic acid and the like can be cited.

The amount of diacetone group in the diacetone-modified polyvinyl alcohol should be around 0.5 mol % to 20 mol % of the polymer as a whole, but when considering water resistance, the range of 2 mol % to 10 mol % is preferable. When this is less than 2%, real water resistance is insufficient, and when this exceeds 10 mol %, economic costs rise with no observed improvement in water resistance.

The degree of polymerization of the diacetone-modified polyvinyl alcohol is preferably 300 to 3,000, and more preferably in the range of 500 to 2,200. In addition, the degree of saponification is preferably 80% or greater.

As the crosslinking agent used in the second protective layer, polyvalent amine compounds such as ethylene diamine; polyvalent aldehyde compounds such as glyoxal, glutalaldehyde and dialdehyde and the like; dihydrazide compounds such as dihydrazide adipate, dihydrazide phthalate or the like; water-soluble methylol compounds (urea, melamine, phenol); multifunctional epoxy compounds; multivalent metal salts (Al, Ti, Zr, Mg and the like); titanium lactate; boric acid or the like can be cited, but this is intended to be illustrative and not limiting. In addition, these may be combined with other commonly known crosslinking agents.

Furthermore, the second protective layer contains acrylic resin or maleic acid copolymer resin.

As the acrylic resin contained in the second protective layer, water-soluble acrylic resins with water-soluble salts of ethylene/acrylic acid copolymers, or water-soluble acrylic resins having as copolymer components ethyl acrylate, butyl acrylate, or acrylate-2-ethyl hexyl as copolymer components, or ester methacrylate, styrene, acrylonitrile, vinyl acetate or the like as copolymer components can be cited. As the maleic acid copolymer resin, water-soluble salts of diisobutylene/maleic acid anhydride copolymers, water-soluble salts of styrene/maleic acid anhydride copolymers and the like can be cited. Among them, water-soluble salts of diisobutylene/maleic acid anhydride copolymers are particularly preferable.

In addition, with the above-described acrylic resin and maleic acid copolymer resin, water-soluble types and emulsion types both yield the same printed image waterproofing effect, but it is preferable to use the water-soluble type because barrier properties such as resistance to plasticizers and oil is degraded when the emulsion type is used.

The amount of acrylic resin and maleic acid copolymer resin added is suitably 1 part to 50 parts by weight per 100 parts by weight of the binder resin. When the amount is less than 1 part by weight, no water-proofing effect is observed with respect to images printed in aqueous flexographic ink. When it exceeds 50 parts by weight, it results in poor sticking property in low-temperature, low-humidity environments.

The second protective layer may contain as a basic filler aluminum hydroxide and/or calcium carbonate, or silicone resin particles.

Aluminum hydroxide and calcium carbonate as basic filler are particulates, with the average particle diameter being not particularly limited; however, in view of head matching characteristics and color development characteristics, the average particle diameter is preferably 0.1 μm to 2 μm or so.

Silicone resin particles are prepared by pulverization of cured silicone resin into fine particles and are of two types according to their shape: spherical shape type and random shape type. It is only necessary for silicone resins employed in the present invention to be a polymer with a three-dimensional network structure having siloxane bonds in its main chain. Silicone resins having methyl groups, phenyl groups, carboxyl groups, vinyl groups, nitrile groups, alkoxy groups or chlorine atoms in the side chains can be widely used. Among such silicone resins, those with methyl groups are generally used. The average particle diameter of silicone resin is not particularly limited; however, it is preferably 0.5 μm to 10 μm or so in view of head matching characteristics and color development characteristics.

The first protective layer contains a water-soluble resin and a crosslinking agent.

As the water-soluble resins (binder resins) and crosslinking agents used in the first protective layer, it is possible to use the same water-soluble resins and crosslinking agents used in the second protective layer. Among these, diacetone-modified polyvinyl alcohol is preferable as the water-soluble resin.

The first protective layer may contain acrylic resin or maleic acid copolymer resin. In addition, as the acrylic resin or maleic acid copolymer resin contained in the first protective layer, in addition to the same resin as in the above-mentioned case of the second protective layer, an aqueous solution of acrylic cation polymer can be cited, but water-soluble salts of diisobutylene/maleic acid anhydride copolymers and an aqueous solution of acrylic cation polymer are particularly preferable.

As the cationic group of the aqueous solution of an acrylic cation polymer, primary to tertiary amino groups, imidazolyl group, pyridyl group, pyrimidinyl group and salts thereof; quaternary ammonium salt groups, and furthermore sulfonium groups and phosphonium groups can be cited.

Specific examples of monomers that can introduce cationic groups include trimethyl ammonium chloride, trimethyl-p-vinyl benzyl ammonium chloride, trimethyl-m-vinyl benzyl ammonium chloride, triethyl-p-vinyl benzyl ammonium chloride, triethyl-m-vinyl benzyl ammonium chloride, N,N-dimethyl-N-ethyl-N-p-vinyl benzyl ammonium chloride, N,N-diethyl-N-methyl-N-p-vinyl benzyl ammonium chloride, N,N-dimethyl-N-n-propyl-N-p-vinyl benzyl ammonium chloride, N,N-dimethyl-N-n-octyl-N-p-vinyl benzyl ammonium chloride, N,N-dimethyl-N-benzyl-N-p-vinyl benzyl ammonium chloride, N,N-diethyl-N-benzyl-N-p-vinyl benzyl ammonium chloride, N,N-dimethyl-N-(4-methyl) benzyl-N-p-vinyl benzyl ammonium chloride, N,N-dimethyl-N-phenyl-N-p-vinyl benzyl ammonium chloride, N,N-dimethyl aminoethyl(meth)acrylate, N,N-diethyl aminoethyl (meth)acrylate, N,N-dimethyl aminopropyl (meth)acrylate, N,N-diethyl aminopropyl(meth)acrylate, N,N-dimethyl aminoethyl(meth)acrylamide, N,N-diethyl aminoethyl (meth) acrylamide, N,N-dimethyl amino propyl(meth)acrylamide, methyl chloride of N,N-diethyl amino propyl(meth)acrylamide, ethyl chloride, methyl bromide, ethyl bromide, quaternized body due to methyl iodide or ethyl iodide, or a sulfonate, an alkyl sulfonate, an acetate or an alkyl carboxylate or the like which substitute the anions of these; diaryl amine, diaryl methylamine, diaryl ethylamine or salts thereof (for example, hydrochloride, acetate, sulfite and the like), diaryl dimethyl ammonium chlorides (chloride, acetic acid ions, sulfuric acid ions and the like as counter anions to that salt), and vinyl pyrindine and N-vinyl imidazole and salts thereof.

The heat-sensitive color-developing layer contains a leuco dye and a developer.

The leuco dye used in the present invention is a compound exhibiting electron donation properties, and may be used singly or in combination of two or more. However, the leuco dye itself is colorless or an orange dye precursor, and commonly known leuco compounds can be used, for example triphenylmethane phthalide compounds, triarylmethane compounds, fluoran compounds, phenothiazine compounds, thiofluoran compounds, xanthen compounds, indolyl phthalide compounds, spiropyran compounds, azaphthalide compounds, chlormenopirazole compounds, methyne compounds, rhodamine anilinolactum compounds, rhodamine lactum compounds, quinazoline compounds, diazaxanthen compounds, bislactone compounds and the like.

In consideration of color development property, and fogging of the background part and color fading of the image part due to moisture, heat or light radiation, specific examples of such compounds are as follows:

2-anilino-3-methyl-6-diethyl amino fluoran, 2-anilino-3-methyl-6-(di-n-butyl amino) fluoran, 2-anilino-3-methyl-6-(di-n-pentyl amino) fluoran, 2-anilino-3-methyl-6-(N-n-propyl-N-methyl amino) fluoran, 2-anilino-3-methyl-6-(N-isopropyl-N-methyl amino) fluoran, 2-anilino-3-methyl-6-(N-isobutyl-N-methyl amino) fluoran, 2-anilino-3-methyl-6-(N-n-amyl-N-methyl amino) fluoran, 2-anilino-3-methyl-6-(N-sec-butyl-N-ethyl amino) fluoran, 2-anilino-3-methyl-6-(N-n-amyl-N-ethyl amino) fluoran, 2-anilino-3-methyl-6-

(N-iso-amyl-N-ethyl amino) fluoran, 2-anilino-3-methyl-6-(N-cyclohexyl-N-ethyl amino) fluoran, 2-anilino-3-methyl-6-(N-ethyl-p-toluidino) fluoran, 2-anilino-3-methyl-6-(N-methyl-p-toluidino) fluoran, 2-(m-trichloro methyl anilino)-3-methyl-6-diethyl amino fluoran, 2-(m-trichloro methyl anilino)-3-methyl-6-diethyl amino fluoran, 2-(m-trichloro methyl anilino)-3-methyl-6-(N-cyclohexyl-N-methyl amino) fluoran, 2-(2,4-dimethyl anilino)-3-methyl-6-diethyl amino fluoran, 2-(N-ethyl-p-toluidino)-3-methyl-6-(N-ethyl anilino) fluoran, 2-(N-methyl-p-toluidino)-3-methyl-6-(N-propyl-p-toluidino) fluoran, 2-anilino-6-(N-n-hexyl-N-ethyl amino) fluoran, 2-(o-chloranilino)-6-diethyl amino fluoran, 2-(o-bromoanilino)-6-diethyl amino fluoran, 2-(o-chloranilino)-6-dibutyl amino fluoran, 2-(o-fluoroanilino)-6-dibutyl amino fluoran, 2-(m-trifluoro methyl aniline)-6-diethylamino fluoran, 2-(p-acetyl anilino)-6-(N-n-amyl-N-n-butyl amino) fluoran, 2-benzyl amino-6-(N-ethyl-p-toluidino) fluoran, 2-benzyl amino-6-(N-methyl-2,4-dimethyl anilino) fluoran, 2-benzyl amino-6-(N-ethyl-2,4-dimethyl anilino) fluoran, 2-dibenzyl amino-6-(N-methyl-p-toluidino) fluoran, 2-dibenzyl amino-6-(N-ethyl-p-toluidino) fluoran, 2-(di-p-methyl benzyl amino)-6-(N-ethyl-p-toluidino) fluoran, 2-(α-phenyl ethyl amino)-6-(N-ethyl-p-toluidino) fluoran, 2-methyl amino-6-(N-methyl aniline) fluoran, 2-methyl amino-6-(N-ethyl aniline) fluoran, 2-methyl amino-6-(N-propyl aniline) fluoran, 2-ethyl amino-6-(N-methyl-p-toluidino) fluoran, 2-methyl amino-6-(N-methyl-2,4-dimethyl anilino) fluoran, 2-ethyl amino-6-(N-methyl-2,4-dimethyl anilino) fluoran, 2-dimethyl amino-6-(N-methyl aniline) fluoran, 2-dimethyl amino-6-(N-ethyl aniline) fluoran, 2-diethyl amino-6-(N-methyl-p-toluidino) fluoran, benzo leuco methylene blue, 2-[3,5-bis(diethyl amino)]-6-(o-chloranilino) xanthyl benzoic acid lactum, 2-[3,5-bis(diethyl amino)]-9-(o-chloranilino) xanthyl benzoic acid lactum, 3,3-bis(p-dimethyl amino phenyl) phtahlide, 3,3-bis(p-dimethyl amino phenyl)-6-dimethyl amino phthalide, 3,3-bis(p-dimethyl amino phenyl)-6-diethyl amino phthalide, 3,3-bis(p-dimethyl amino phenyl)-6-chlorphthalide, 3,3-bis(p-dibutyl amino phenyl) phthalide, 3-(2-methoxy-4-dimethyl amino phenyl)-3-(2-hydroxy-4,5-dichlorphenyl) phthalide, 3-(2-hydroxy-4-dimethyl amino phenyl)-3-(2-methoxy-5-chlorphenyl) phthalide, 3-(2-hydroxy-4-dimethoxy amino phenyl)-3-(2-methoxy-5-chlorphenyl) phthalide, 3-(2-hydroxy-4-dimethoxy amino phenyl)-3-(2-methoxy-5-nitrophenyl) phthalide, 3-(2-hydroxy-4-ethyl amino phenyl)-3-(2-methoxy-5-methyl phenyl) phthalide, 3,6-bis(dimethyl amino) fluoranspiro(9,3')-6'-dimethyl amino phthalide, 6'-chloro-8'-methoxy-benzoindolino spiropyran, 6'-bromo-2'-methoxy benzoindolino spiropyran and the like.

The amount of leuco dye contained in the heat-sensitive color-developing layer is preferably 5% by weight to 20% by weight, and more preferably 10% by weight to 15% by weight.

In addition, as the developer used in the present invention, various electron accepting substances are suitable which react with the aforementioned leuco dye at the time of heating and cause this to develop colors; specific examples thereof are phenolic compounds, organic or inorganic acidic compounds and esters or salts thereof, including: bisphenol A, tetrabromobisphenol A, gallnut acid, salicylic acid, 3-isopropyl salicylate, 3-cyclohexyl salicylate, 3-5-di-tert-butyl salicylate, 3,5-di-α-methyl benzyl salicylate, 4,4'-isopropylidenediphenol, 1,1'-isopropylidene his (2-chlorophenol), 4,4'-isopropylene his (2,6-dibromophenol), 4,4'-isopropylidene his (2,6-dichlorophenol), 4,4'-isopropylidene bis(2-ethyl phenol), 4,4'-isopropylidene bis(2,6-dimethyl phenol), 4,4'-isopropylidene his (2-tert-butyl phenol), 4,4'-sec-butylidene diphenol, 4,4'-cyclohexylidene bisphenol, 4,4'-cyclohexylidene his (2-ethyl phenol), 4-tert-butyl phenol, 4-phenyl phenol, 4-hydroxy diphenoxide, α-naphthol, β-naphthol, 3,5-xylenol, thymol, methyl-4-hydroxybenzoate, 4-hydroxyacetophenone, novolak phenol resins, 2,2'-thio bis(4,6-dichloro phenol), catechol, resorcin, hydroxynone, hydroquinone, pyrogallol, fluoroglycine, fluoroglycine carbonate, 4-tert-octyl catechol, 2,2'-methylene his (4-chlorophenol), 2,2'-methylene his (4-methyl-6-tert-butyl phenol), 2,2'-dihydroxy diphenyl, ethyl p-hydroxybenzoate, propyl p-hydroxybenzoate, butyl p-hydroxybenzoate, benzyl p-hydroxybenzoate, p-hydroxybenzoate-p-chlorobenzyl, p-hydroxybenzoate-o-chlorobenzyl, p-hydroxybenzoate-p-methylbenzyl, p-hydroxybenzoate-n-octyl, benzoic acid, zinc salicylate, 1-hydroxy-2-naphthoic acid, 2-hydroxy-6-naphthoic acid, 2-hydroxy-6-zinc naphthoate, 4-hydroxy diphenyl sulphone, 4-hydroxy-4'-chloro diphenyl sulfone, his (4-hydroxy phenyl) sulfide, 2-hydroxy-p-toluic acid, 3,5-di-tert-zinc butyl salicylate, 3,5-di-tert-tin butyl salicylate, tartaric acid, oxalic acid, maleic acid, citric acid, succinic acid, stearic acid, 4-hydroxyphthalic acid, boric acid, thiourea derivative, 4-hydroxy thiophenol derivative, bis(4-hydroxyphenyl) acetate, bis(4-hydroxyphenyl)ethyl acetate, his (4-hydroxyphenyl acetate-n-propyl, his (4-hydroxyphenyl) acetate-n-butyl, his (4-hydroxyphenyl) phenyl acetate, his (4-hydroxyphenyl) benzyl acetate, his (4-hydroxyphenyl) phenethyl acetate, his (3-methyl-4-hydroxyphenyl) acetate, bis(3-methyl-4-hydroxyphenyl) methyl acetate, his (3-methyl-4-hydroxyphenyl) acetate-n-propyl, 1,7-bis(4-hydroxyphenylthio) 3,5-dioxaheptane, 1,5-bis(4-hydroxyphenylthio) 3-oxaheptane, 4-hydroxy phthalate dimethyl, 4-hydroxy-4'-methoxy phenyl sulfone, 4-hydroxy-4'-ethoxy diphenyl sulfone, 4-hydroxy-4'-isopropoxy diphenyl sulfone, 4-hydroxy-4'-propoxy diphenyl sulfone, 4-hydroxy-4'-butoxy diphenyl sulfone, 4-hydroxy-4'-isopropoxy diphenyl sulfone, 4-hydroxy-4'-sec-butoxy diphenyl sulfone, 4-hydroxy-4'-tert-butoxy diphenyl sulfone, 4-hydroxy-4'-benzyloxy diphenyl sulfone, 4-hydroxy-4'-phenoxy diphenyl sulfone, 4-hydroxy-4'-(m-methyl benzoxy) diphenyl sulfone, 4-hydroxy-4'-(p-methyl benzoxy) diphenyl sulfone, 4-hydroxy-4'-(o-methyl benzoxy) diphenyl sulfone, 4-hydroxy-4'-(p-chloro benzoxy) diphenyl sulfone, 4-hydroxy-4'-oxyaryl diphenyl sulfone and the like.

The mixing ratio between the leuco dye and the developer in the heat-sensitive recording layer is preferably 0.5 parts by weight to 10 parts by weight of the developer with respect to 1 part by weight of the leuco dye, and more preferably 1 part by weight to 5 parts by weight.

Besides the above-described leuco dye and developer, in the heat-sensitive recording layer it is possible to appropriately add other materials customarily utilized in heat-sensitive recording materials, such as binders, fillers, thermofusing materials, crosslinking agents, pigments, surfactants, fluorescent whitening agents, lubricants and so forth.

Binders may be used as necessary in order to improve the adhesiveness and coating ability of the layer. Specific examples include: starches, hydroxyethyl cellulose, methyl cellulose, carboxy methyl cellulose, gelatin, casein, Arabia rubber, polyvinyl alcohol, salts of diisobutylene/maleic acid anhydride copolymers, salts of styrene/maleic acid anhydride copolymers, salts of ethylene/maleic acid anhydride copolymers, salts of styrene/acryl copolymers, emulsion salts of styrene/butadiene copolymers, and the like.

As fillers, examples include, but not limited to, inorganic pigments such as calcium carbonate, aluminum oxide, zinc oxide, titanium dioxide, silica, aluminum hydroxide, barium sulfate, talc, kaolin, alumina and clay, and commonly known organic pigments. In addition, when waterproofing (resistance against peeling off due to water) is taken into consideration, acidic pigments (those which exhibit acidity in aqueous solutions) such as silica, alumina and kaolin are preferable, and silica is particularly preferable from the viewpoint of developed color density.

It is also preferable to jointly use thermofusing materials, and specific examples of these which can be cited include: fatty acids such as stearic acid, behenic acid and the like; fatty acid amides such as stearic acid amide, erucic acid amide, palmitic acid amide, behenic acid amide, palmitic acid amide and the like; N-substituted amides such as N-lauryl lauric acid amide, N-stearyl stearic acid amide, N-oleyl stearic acid amid and the like; bis fatty acid amides such as methylene his stearic acid amide, ethylene bis stearic acid amide, ethylene his lauric acid amide, ethylene his capric acid amide, ethylene his behenic acid amide and the like; hydroxyl fatty acid amides such as hydroxyl stearic acid amide, methylene his hydroxyl stearic acid amide, ethylene his hydroxyl stearic acid amide, hexamethylene his hydroxy stearic acid amide and the like; metal salts of fatty acids, such as zinc stearate, aluminum stearate, calcium stearate, zinc palmitate, zinc behenate and the like; or p-benzyl biphenyl, terphenyl, triphenyl methane, p-benzyloxybenzoate benzyl, β-benzyloxy naphthalene, phenyl β-naphthoate, 1-hydroxy-2-phenyl naphthoate, 1-hydroxy-2-methyl naphthoate, diphenyl carbonate, benzyl terephthalate, 1,4-dimethoxy naphthalene, 1,4-diethoxy naphthalene, 1,4-dibenzyloxy naphthalene, 1,2-diphenoxy ethane, 1,2-his (4-methyl phenoxy ethane), 1,4-diphenoxy-2-butene, 1,2-bis(4-methoxy phenyl thio) ethane, dibenzoyl methane, 1,4-diphenylthio butane, 1,4-diphenylthio-2-butene, 1,3-bis(2-vinyloxy ethoxy) benzene, 1,4-bis(2-vinyloxy ethoxy) benzene, p-(2-vinyloxy ethoxy) biphenyl, p-aryloxy biphenyl, dibenzoyloxymethane, dibenzoyloxypropane, dibenzyl sulfide, 1,1-diphenyl ethanol, 1,1-diphenyl propanol, p-benzyloxy benzyl alcohol, 1,3-phenoxy-2-propanol, N-octadecyl carbamoyl-p-methoxy carbonyl benzene, N-octadecyl carbamoyl benzene, 1,2-bis (4-methoxyphenoxy) propane, 1,5-bis(4-methoxyphenoxy)-3-oxapentane, dibenzyl ethanedioate, his (4-methyl benzyl) ethanedioate, his (4-chlorobenzyl)ethanedioate and the like. These may be used singly or in combination.

In recent years, fluorescent whitening agents have been included to whiten the background area and improve appearance, but from the perspectives of the effect of improving background whiteness and the stability of the protective layer solution, diaminostilbene compounds are preferable.

Furthermore, this is preferable because when diacetone-modified polyvinyl alcohol is contained in the heat-sensitive color-developing layer, when N-aminopolyacryl amide is contained as a crosslinking agent in the protective layers or the heat-sensitive color-developing layer and protective layers, a crosslinking reaction occurs readily and waterproofing is improved without adding other crosslinking agents that could impede color formation.

The heat-sensitive recording layer can be formed though a commonly known method, and for example after the leuco dye and developer, along with binders and other components, are pulverized and dispersed to a particle diameter of 1 μm to 3 μm by a disperser such as a ball mill, Atriter, sand mill or the like, these along with filler and thermofusing material (sensitizer) dispersion liquid or the like are mixed with a uniform prescription to prepare a heat-sensitive recording layer coating solution, and the layer is formed by coating this on the substrate.

The thickness of the heat-sensitive recording layer varies depending on the composition of the heat-sensitive recording layer and intended use of the heat-sensitive recording materials and cannot be specified flatly, but it is preferably 1 μm to 50 μm, and more preferably 3 μm to 20 μm.

The under layer contains a binder resin and plastic hollow particles, and furthermore preferably contains other components as necessary.

The plastic hollow particle has a hull or shell made of thermoplastic resin and contains therein air or other gas. They are fine hollow particles already in a foamed state, and the average particle diameter (outer particle diameter) is preferably 0.2 μm to 20 μm, and more preferably 2 μm to 5 μm. When the average particle diameter is smaller than 0.2 μm, it is technically difficult to make particles hollow and the function of the under layer becomes insufficient. On the other hand, when the above diameter is larger than 20 μm, the smoothness of the dried coating surface decreases, so the coating of the heat-sensitive recording layer becomes non-uniform, and it is required to apply larger amount of heat-sensitive recording layer coating solution than necessary in order to provide uniform layer.

Accordingly, along with the average particle diameter being within the aforementioned range, it is preferable to have a particles with a uniform distribution peak with little variance.

Furthermore, the above-described fine hollow particles preferably have a hollow ratio of 30% to 95%, and more preferably 80% to 95%. In particles with a hollow ratio of less than 30%, thermal insulating properties are insufficient, so heat energy from the thermal heat is emitted to the outside of the heat-sensitive recording material via the substrate, so sensitivity improvement effect becomes inadequate. The hollow ratio referred to here is the ratio of the inside diameter (the diameter of the hollow part) of the hollow particles to the outside diameter, and can be expressed by the following equation:

$$\text{Hollow ratio}=(\text{inner diameter of the hollow particles}/\text{outer diameter of the hollow particles})\times 100$$

The aforementioned fine hollow particles have a hull of thermoplastic resin as noted above, and examples such thermoplastic resins include styrene-acrylic resins, polystyrene resins, acrylic resins, polyethylene resins, polypropylene resins, polyacetal resins, polyether chloride resins, vinyl polychloride resins, and copolymer resins whose main components are vinylidene chloride and acrylonitrile. In addition, as thermoplastic materials, examples include: phenol formaldehyde resins, urea formaldehyde resins, melamine formaldehyde resins, furan resins or the like, or unsaturated polyester resin created through additional polymerization, bridged MMA resin or the like. Of these, styrene acrylic resin and copolymer resins whose main components are vinylidene chloride and acrylonitrile are suitable for blended application because the hollow ratio is high and the variance in particle diameters is small.

The coating amount of the plastic hollow particles needs to be 1 g to 3 g per square meter of the substrate in order to maintain sensitivity and coating uniformity. When the amount is less than 1 g/m$^2$, inadequate sensitivity results, and when the amount exceeds 3 g/m$^2$, layer adhesiveness decreases.

The shape, structure and size of the substrate can be appropriately selected in accordance with the intended purpose. The shape of the substrate may be, for example, a flat board shape, and the structure may be a single-layer structure or a multi-layer structure. The size can be appropriately selected in accordance with the size of the heat-sensitive recording materials or the like.

Materials of the substrate can be appropriately selected in accordance with the objective, and various inorganic materials or organic materials can be used.

As inorganic materials, examples include: glass, quartz, silicon, silicon oxide, aluminum oxide, $SiO_2$, metals and the like. As organic materials, examples include paper, such as fine-quality paper, art paper, coated paper, synthetic paper or the like; cellulose derivatives such as triacetyl cellulose or the like; or polymer film selected from among polyester resins such as polyethylene terephthalate (PET), polybutylene terephthalate or the like, polycarbonate, polystyrene, polymethyl methacrylate, polyethylene, polypropylene or the like. Among these, fine-quality paper, art paper, coated paper and polymer film are preferable. These may be used singly or in combination.

The substrate is preferably subjected to surface modification treatment such as corona discharge treatment, oxide reaction treatment (by use of chromic acid or the like), etching treatment, adhesion treatment, charging prevention treatment and the like for the purpose of improving the adhesiveness of the coating layer. In addition, it is preferable for the substrate to be whitened by adding a white pigment such as titanium oxide or the like.

The thickness of the substrate can be appropriately selected in accordance with the objective, but the thickness is preferably 50 μm to 2,000 μm, and more preferably 100 μm to 1,000 μm.

It is preferable for the heat-sensitive recording material of the present invention to have back layers containing pigments, water-soluble resin (binder resin) and crosslinking agents on the surface of the substrate on the side opposite (the back side of) the side on which the heat-sensitive recording layer is provided.

Other components may also be contained in the back layer, such as fillers, lubricants and the like.

As binder resins, any water-dispersion resin or water-soluble resin can be used, and specifically, commonly know water-soluble polymers and aqueous polymer emulsions can be cited.

Water-soluble polymers that can be cited include: polyvinyl alcohol, starch and derivatives thereof, cellulose derivatives such as methoxy cellulose, hydroxy ethyl cellulose, carobxy methyl cellulose, methyl cellulose and ethyl cellulose, polyacrylate soda, polyvinyl pyrrolidone, acryl amide-ester acrylate copolymers, acryl amide-ester acrylate-copolymers, alkali salts of styrene-maleic acid anhydride copolymers, alkali salts of isobutylene-maleic acid anhydride copolymers, polyacrylamide, alginate soda, gelatin, casein and the like. These may be used singly or in combination.

Examples of aqueous polymer emulsions include latexes such as acrylate ester copolymers, styrene/butadiene copolymers and styrene/butadiene/acryl copolymers, or emulsions of vinyl acetate resin, vinyl acetate/acrylate copolymers, styrene/ester acrylate copolymers, ester acrylate resins, polyurethane resins or the like. These may be used independently, or two or more may be used together.

As crosslinking agents, those used for the above-described second protective layer can be used. As fillers, inorganic fillers or organic fillers can be used.

Examples of inorganic fillers include carbonate, silicate, metal acid compounds, sulfate compounds and the like. Examples of organic fillers include silicone resins, cellulose resins, epoxy resins, nylon resins, phenol resins, polyurethane resins, urea resins, melamine resins, polyester resins, polycarbonate resins, styrene resins, acrylic resins, polyethylene resins, formaldehyde resins, polymethyl methacrylate resins and the like.

The method of forming the back layer can be appropriately selected in accordance with the intended purpose, but the method of forming the layer by coating the back layer coating solution on the substrate is suitable.

The coating method can also be appropriately selected in accordance with the intended purpose; for example, spin coating, dip coating, kneader coating, curtain coating, or blade coating can be used.

The thickness of the back layer can be appropriately selected in accordance with intended purpose, but is preferably 0.1 μm to 10 μm, and more preferably 0.5 μm to 5 μm.

A heat-sensitive recording label, one of the use forms of the heat-sensitive recording materials, as a first embodiment, has an adhesive layer and separation paper sequentially provided over the back surface or back layer surface of the substrate of the heat-sensitive recording material, and has other components as necessary.

The materials of the adhesive layer can be appropriately selected in accordance with the intended purpose, examples thereof include urea resins, melamine resins, phenol resins, epoxy resins, vinyl acetate resins, vinyl acetate/acrylic copolymers, ethylene/vinyl acetate copolymers, acrylic resins, polyvinyl ether resins, vinyl chloride/vinyl acetate copolymers, polystyrene resins, polyester resins, polyurethane resins, polyamide resins, polyolefin chloride resins, polyvinyl butyral resins, ester acrylate copolymers, ester methacrylate copolymers, natural rubber, cyanoacrylate resins, silicone resins. These may be used singly or in combination.

As a second embodiment, the heat-sensitive recording layer has a heat-sensitive adhesive layer that exerts adhesiveness upon heat over the back surface or back layer surface of the substrate of the heat-sensitive recording material, and has other components as necessary.

The heat-sensitive adhesive layer contains a thermoplastic resin and a thermofusing material, and furthermore contains a binder as necessary. The thermoplastic resin provides the layer with viscosity and adhesiveness. The thermofusing material is a solid at room temperature and thus provides no plasticity, but it melts when heated, causing the resin to swell and soften, thereby exerting adhesiveness. In addition, the adhesive agent has the action of increasing adhesiveness.

Heat-sensitive recording magnetic paper, which is another usage form of the heat-sensitive recording material, has a magnetic recording layer over the back surface or back layer surface of the substrate of the heat-sensitive recording material and has other components as necessary.

The magnetic recording layer is formed on the substrate either by coating method using iron oxide and barium ferrite or the like together with vinyl chloride resin, urethane resin, nylon resin or the like, or by vapor deposition or sputtering without using resins.

The magnetic recording layer is preferably provided on the surface on the opposite side of the substrate from the heat-sensitive color-developing layer, but may also be provided between the substrate and the heat-sensitive color-developing layer or on portions of the heat-sensitive color-developing layer.

The shape of the heat-sensitive recording material of the present invention can be appropriately selected in accordance with the intended purpose, but label shape, sheet shape and roll shape are suitable.

Recording using the heat-sensitive recording material of the present invention can be accomplished using a thermal pen, a thermal head, laser heating or the like depending on the usage objective, and there are no particular limitations.

The heat-sensitive recording material of the present invention may be suitably used in a variety of fields including POS fields (e.g., labels for perishable foods, box lunches, side dishes); copying field (e.g., documents); communication field (e.g., facsimiles); ticketing field (e.g., ticket-vending machines, receipts; and package tags in the airline industry).

According to the present invention, a heat-sensitive recording material can be provided that can be applied with high speed, has high sensitivity and storage stability, and in addition which has superior printing suitability and head matching properties.

EXAMPLES

The present invention will be described in more detail below with reference to Examples and Comparative Examples, but the present invention is in no way limited by these Examples. In addition, hereinafter "parts" and "%" shall in each case mean "parts by weight" and "% by weight," unless otherwise indicated.

Example 1

Production of Heat-Sensitive Recording Material (1) Preparation of Under Layer Coating Solution
[Liquid A]

| | |
|---|---|
| Plastic spherical hollow microparticles (copolymer resin whose main component is styrene-acrylic acid; product name: Ropaque HP-91 produced by Rohm and Haas Company; solid content = 27.5%; average particle diameter = 1 μm, hollow ratio = 50%): | 36 parts |
| Styrene-butadiene copolymer latex (product name: SMARTEX PA-9159 produced by NIPPON A & L Inc.; solid content = 47.5%): | 10 parts |
| Water-- | 54 parts |

(2) Preparation of Heat-Sensitive Color-Developing Layer Coating Solution
[Liquid B]

| | |
|---|---|
| 2-anilino-3-methyl-6-(di-n-butyral amino) fluoran: | 20 parts |
| 10% aqueous solution of itaconic acid-modified polyvinyl alcohol (modification rate = 1 mol %): | 20 parts |
| Water: | 60 parts |

[Liquid C]

| | |
|---|---|
| 4-hydroxy-4'-isopropoxy phenyl sulfone: | 20 parts |
| 10% aqueous solution of itaconic acid-modified polyvinyl alcohol (modification rate = 1 mol %): | 20 parts |
| Silica: | 10 parts |
| Water: | 50 parts |

Liquid B and Liquid C having the above-described compositions were dispersed using a sand mill so that each had an average particle diameter of 1.0 μm or less, thereby preparing dye dispersion liquid [Liquid B] and developer dispersion liquid [Liquid C].

Next, Liquid B and Liquid C were mixed in proportions of 1:7 with the solid content adjusted to 25%, and then stirred to produce heat-sensitive color-developing layer coating solution [Liquid D].

(3) Preparation of First Protective Layer Coating Solution
[Liquid E]

| | |
|---|---|
| 10% aqueous solution of itaconic acid-modified polyvinyl alcohol (modification rate = 1 mol %): | 100 parts |
| Polyamide epichlorhydrine resin (product name: WS535 produced by Seiko PMC Corporation): | 30 parts |
| Water: | 100 parts |

The above materials were mixed and stirred to produce first protective layer coating solution [Liquid E].

(4) Preparation of Second Protective Layer Coating Solution
[Liquid F]

| | |
|---|---|
| Aluminum hydroxide (average particle diameter: 0.6 μm; HIGILITE H-43M, made by Showa Denko KK): | 20 parts |
| 10% aqueous solution of itaconic acid-modified polyvinyl alcohol (modification rate = 1 mol %): | 20 parts |
| Water: | 60 parts |

The above materials were dispersed for 24 hours using a sand mill to produce Liquid F.

[Liquid G]

| | |
|---|---|
| Liquid F: | 75 parts |
| 10% aqueous solution of diacetone-modified polyvinyl alcohol (modification rate = 4 mol %): | 100 parts |
| 10% aqueous solution of adipic acid dihydrazide: | 10 parts |
| Acrylic resin (Joncryl-74J, made by Johnson Polymer): | 20 parts |
| Water: | 90 parts |

The above materials were mixed and stirred to produce second protective layer coating solution [Liquid G].

Next, a surface of paper substrate (fine-grade paper with a basis weight of 60 g/m$^2$) was coated with Liquid A by blade coating and dried such that the deposition amount after drying was 3.0 g/m$^2$, to form a under coat layer thereon.

Subsequently, the heat-sensitive color-developing layer coating solution [Liquid D], the first protective layer coating solution [Liquid E] and the second protective layer coating solution [Liquid G] were simultaneously applied on the under coat layer by curtain coating at a speed of 600 m/min and dried so that the deposition amounts after drying were 5.0 g/m$^2$, 1.0 g/m$^2$, and 1.0 g/m$^2$, respectively, and calender treatment was conducted so that the surface has an Oken smoothness of around 2,000 seconds. In this way the heat-sensitive recording material of Example 1 was produced.

Example 2

Production of Heat-Sensitive Recording Material

Production of the heat-sensitive recording material of Example 2 was conducted as in Example 1 except that Liquid E in Example 1 was replaced by the Liquid H below.

[Liquid H]

| | |
|---|---|
| 10% aqueous solution of diacetone-modified polyvinyl alcohol (modification rate = 4 mol %): | 100 parts |
| 10% aqueous solution of adipic acid dihydrazide: | 10 parts |
| Acrylic resin (Joncryl-74J, made by Johnson Polymer): | 10 parts |
| Water: | 100 parts |

The above materials were mixed and stirred to produce first protective layer coating solution [Liquid H].

Example 3

Production of Heat-Sensitive Recording Material

Production of the heat-sensitive recording material of Example 3 was conducted as in Example 1 except that Liquid G in Example 1 was replaced by the below-described Liquid I.

[Liquid I]

| | |
|---|---|
| Liquid F: | 75 parts |
| 10% aqueous solution of diacetone-modified polyvinyl alcohol (modification rate = 4 mol %): | 100 parts |
| 10% aqueous solution of adipic acid dihydrazide: | 10 parts |
| Ammonium salt of diisobutylene-maleic acid anhydride (molar ratio of diisobutylene to maleic acid anhydride = 1/1): | 20 parts |
| Water: | 90 parts |

The above materials were mixed and stirred to produce second protective layer coating solution [Liquid I].

Example 4

Production of Heat-Sensitive Recording Material

Production of the heat-sensitive recording material of Example 4 was conducted as in Example 2 except that Liquid H in Example 2 was replaced by the below-described Liquid J.

[Liquid J]

| | |
|---|---|
| 10% aqueous solution of diacetone-modified polyvinyl alcohol (modification rate = 4 mol %): | 100 parts |
| 10% aqueous solution of adipic acid dihydrazide: | 10 parts |
| Ammonium salt of diisobutylene-maleic acid anhydride (molar ratio of diisobutylene to maleic acid anhydride = 1/1): | 10 parts |
| Water: | 100 parts |

The above materials were mixed and stirred to produce the first protective layer coating solution [Liquid J].

Example 5

Production of Heat-Sensitive Recording Material

Production of the heat-sensitive recording material of Example 5 was conducted as in Example 2 except that Liquid H in Example 2 was replaced by the below-described Liquid K.

[Liquid K]

| | |
|---|---|
| 10% aqueous solution of diacetone-modified polyvinyl alcohol (modification rate = 4 mol %): | 100 parts |
| 10% aqueous solution of adipic acid dihydrazide: | 10 parts |
| Acrylic cationic resin (Chemistat 7005, made by Sanyo Chemical Industries Ltd.): | 5 parts |
| Water: | 100 parts |

The above materials were mixed and stirred to produce first protective layer coating solution [Liquid K].

Example 6

Production of Heat-Sensitive Recording Material

Production of the heat-sensitive recording material of Example 6 was conducted as in Example 4 except that Liquid G in Example 4 was replaced by the below-described Liquid L.

[Liquid L]

| | |
|---|---|
| Above-described Liquid E: | 75 parts |
| 10% aqueous solution of diacetone-modified polyvinyl alcohol (modification rate = 4 mol %): | 100 parts |
| 10% aqueous solution of adipic acid dihydrazide: | 10 parts |
| Ammonium salt of diisobutylene-maleic acid anhydride (molar ratio of diisobutylene to maleic acid anhydride = 1/1): | 10 parts |
| room-temperature-curable silicone resin (product name = SE 1980 produced by Dow Corning Toray; solid content = 45%): | 0.5 part |
| Water: | 100 parts |

The above materials were mixed and stirred to produce first protective layer coating solution [Liquid L].

Example 7

Production of Heat-Sensitive Recording Material

Production of the heat-sensitive recording material of Example 7 was conducted as in Example 3 except that aluminum hydroxide in Liquid F was replaced with calcium carbonate (average particle diameter=0.5 μm; CALSHITEC Brilliant-15, made by Shiraishi Kogyo).

Example 8

Production of Heat-Sensitive Recording Material

Production of the heat-sensitive recording material of Example 8 was conducted as in Example 4 except that the plastic spherical hollow microparticles (copolymer resin whose main component is styrene-acrylic acid; product name: Ropaque HP-91 produced by Rohm and Haas Company; solid content=27.5%, average particle diameter=1 μm, hollow ratio=50%) was replaced with vinylidene chloride/acrylonitrile copolymer (molar ratio of vinylidene chloride to acrylonitrile=6/4; solid content=27.5%; average particle diameter=3 μm; and hollow ratio=90%.

Example 9

Production of Heat-Sensitive Recording Material

Production of the heat-sensitive recording material of Example 9 was conducted as in Example 4 except that a back layer coating solution having the following materials was prepared and then applied onto the substrate on the side opposite from the heat-sensitive color-developing layer, with the deposition amount after drying being 1.5 g/mm$^2$.

(4) Preparation of Back Layer Coating Solution

| | |
|---|---|
| [Liquid L]: | 50 parts |
| 10% aqueous solution of polyvinyl alcohol: | 100 parts |
| 10% aqueous solution of polyamide epichlorhydrine (product name: WS535 produced by Seiko PMC Corporation): | 30 parts |
| Water: | 100 parts |

Comparative Example 1

Preparation of Heat-Sensitive Recording Material

The heat-sensitive recording material of Comparative Example 1 was prepared as in Example 1 except that acrylic resin was not used in the second protective layer.

Comparative Example 2

Preparation of Heat-Sensitive Recording Material

The heat-sensitive recording material of Comparative Example 2 was prepared as in Example 1 except that the 10% aqueous solution of diacetone-modified polyvinyl alcohol (modification rate=4 mol %) in the second protective layer of Example 1 was replaced with a 10% aqueous solution of itaconic acid-modified polyvinyl alcohol (modification rate=1 mol %) and that the 10% aqueous solution of adipic acid dihydrazide was replaced with a 10% aqueous solution of polyamide epichlorhydrine (product name: WS535 produced by Seiko PMC Corporation).

Comparative Example 3

Preparation of Heat-Sensitive Recording Materials

The heat-sensitive recording material of Comparative Example 3 was prepared as in Example 1 except that the heat-sensitive color-developing coating solution, the first protective layer coating solution and the second protective layer coating solution were applied using a rod bar.

The properties of the various heat-sensitive recording materials obtained as described above were evaluated as follows. Results are shown in Table 1.

<Sensitivity Ratio>

The various heat-sensitive recording materials were printed each 1 msec with a pulse width of 0.2 msec to 1.2 msec under a head power of 0.45 W/dot, a recording time per line of 20 msec/L and a scanning density of 8×385 dots/mm, the printing density was measured using a Macbeth RD-914 densitometer, and the pulse width that produced a density of 1.0 was calculated.

The sensitivity ratio was calculated using the following equation, using Comparative Example 1 as the standard. The larger the value, the better the sensitivity (thermal reactivity).

Sensitivity ratio=(Pulse width of Comparative Example 1)/(measured pulse width of sample)

<Waterproofing Evaluation of Aqueous Flexographic Ink>

Aqueous flexographic ink (MTQ 30302-404, made by AKZO Nobel) diluted to 25% was coated onto the various heat-sensitive recording materials using a wire bar that has a wire diameter of ϕ0.10, and was then dried for one hour in an atmosphere of 23° C. and 50% relative humidity. Following this, one drop of water was dropped onto the printed image and five minutes later was strongly rubbed one time using a finger, and the waterproofing property was evaluated based on how the printed image peeled off.

The evaluation standards for the waterproof peeling test of aqueous flexographic ink is as follows:

A: Absolutely no peeling in the printed part

B: Less than 25% peeling occurred in the printed part

C: 25% or more but less than 50% peeling occurred in the printed part

D: 50% or more peeling occurred in the printed part.

<Resistance to Plasticizer>

Color was developed by bringing a 150° C. hot stamp into contact with each of the heat-sensitive recording materials for one second, and then three vinyl chloride wraps were layered on the heat-sensitive color-developing layer surface side, a load of 5 kg/100 $cm^2$ was applied under a dry atmosphere at 40° C. and after 15 hours storage, and the post-storage image density was measured using a Macbeth densitometer (model RD-914, made by Macbeth Corp.).

<Resistance to Plasticizer of Back Surface>

Color was developed by bringing a 150° C. hot stamp into contact with each of the heat-sensitive recording materials for one second, and then three vinyl chloride wraps were layered on the back surface side, a load of 5 kg/100 $cm^2$ was applied under a dry atmosphere at 50° C. and after 15 hours storage, and the post-storage image density was measured using a Macbeth densitometer (model RD-914, made by Macbeth Corp.).

<Transferability Under High-Temperature, High-Humidity Conditions>

After the various heat-sensitive recording materials and a printer (SM-90, made by Teraoka Seiko Co.) were allowed to stand for one hour in a high-temperature, high-humidity environment at 40° C. and 90% relative humidity, printing was conducted and evaluation was made based on printing length. The printing length is the length from the printing start area to the printing last area when a specific printing pattern is printed using the printer. When the transferability is excellent, the printing patter is correctly printed and the printing length of the printing pattern and the printing length of the sample actually printed match, whereas when the transferability is poor, transferability problems arise due to the heat-sensitive recording material and thermal head sticking to each other, so the printing area is shortened when printed, and moreover meandering occurs when the heat-sensitive recording material is transferred, so that the printing length of the sample actually printed is shorter than the printing length of the printing pattern. In the present test, a printing pattern with a printing length of 100 mm was used.

<Dot Reproducibility>

The dot reproducibility of an image that used the heat-sensitive magnification testing method was evaluated with the naked eye for the various heat-sensitive recording materials. The evaluation criteria are as follows:

A: Excellent

B: Good

C: Normal

D: Poor

TABLE 1

| | Sensitivity ratio | Aqueous flexographic ink water separation | Resistance to plasticizer | Resistance to plasticizer of back surface | Transferability | Dot reproducibility |
|---|---|---|---|---|---|---|
| Ex. 1 | 1.00 | C | 1.23 | 1.20 | 90 mm | B |
| Ex. 2 | 1.00 | B | 1.23 | 1.21 | 90 mm | B |
| Ex. 3 | 1.01 | B | 1.23 | 1.20 | 98 mm | B |
| Ex. 4 | 1.01 | A | 1.22 | 1.20 | 95 mm | B |
| Ex. 5 | 1.00 | A | 1.24 | 1.21 | 95 mm | B |
| Ex. 6 | 0.99 | A | 1.23 | 1.20 | 100 mm | B |
| Ex. 7 | 1.00 | B | 1.23 | 1.20 | 98 mm | B |
| Ex. 8 | 1.12 | A | 1.26 | 1.20 | 90 mm | A |
| Ex. 9 | 1.00 | A | 1.22 | 1.25 | 90 mm | B |
| Comp. Ex. 1 | 1.00 | D | 1.23 | 1.20 | 98 mm | B |
| Comp. Ex. 2 | 1.00 | C | 1.21 | 1.21 | 50 mm | B |
| Comp. Ex. 3 | 1.00 | C | 1.10 | 1.20 | 95 mm | B |

What is claimed is:

1. A heat-sensitive recording material comprising:

a substrate;

a heat-sensitive color-developing layer over the substrate, the heat-sensitive color-developing layer containing a leuco dye and a developer;

a first protective layer over the heat-sensitive color-developing layer, the first protective layer containing a water-soluble resin and a crosslinking agent; and a second protective layer over the first protective layer, the second protective layer containing a water-soluble resin, a crosslinking agent and a pigment, wherein the heat-sensitive color-developing layer, the first protective layer and the second protective layer are formed simultaneously by curtain coating method, and the second protective layer contains diacetone-modified polyvinyl alcohol and acrylic resin, and wherein the acrylic resin included in the second protective layer is a water-soluble salt of an ethylene/acrylic acid copolymer, and wherein the first protective layer contains acrylic resin, and the first protective layer is formed utilizing an aqueous solution of an acrylic cation polymer in the curtain coating method.

* * * * *